United States Patent [19]

Potapkin et al.

[11] Patent Number: 4,541,263

[45] Date of Patent: Sep. 17, 1985

[54] ROLL MILL STAND

[75] Inventors: Viktor F. Potapkin; Igor A. Morozov; Vladimir A. Fedorinov; Alexandr S. Ravich, all of Donetskaya, U.S.S.R.

[73] Assignee: Kramatorsky Industrialny Institut, Kranatorsky, U.S.S.R.

[21] Appl. No.: 486,994

[22] Filed: Apr. 21, 1983

[51] Int. Cl.[4] ..... B21B 37/00

[52] U.S. Cl. ..... 72/243; 72/240; 74/110; 474/123

[58] Field of Search ..... 72/199, 237, 241, 243, 72/244; 72/240; 474/123, 102, 105, 103, 106, 104, 107, 108

[56] References Cited

U.S. PATENT DOCUMENTS

| | | | |
|---|---|---|---|
| 3,307,386 | 3/1967 | Ward et al. | 72/241 |
| 3,359,689 | 12/1967 | McCarty et al. | 474/123 |
| 3,426,567 | 2/1969 | Smith | 72/240 |
| 3,442,109 | 5/1969 | Diolot | 72/240 |
| 3,531,960 | 10/1970 | Stone | 72/8 |
| 3,616,669 | 11/1971 | Shumaker | 72/200 |
| 4,023,426 | 5/1977 | Duryea et al. | 474/123 |
| 4,385,512 | 5/1983 | Matsumoto et al. | 72/234 |
| 4,403,454 | 9/1983 | Glore et al. | 474/123 |

FOREIGN PATENT DOCUMENTS

| | | | |
|---|---|---|---|
| 14404 | 1/1982 | Japan | 72/240 |
| 159202 | 10/1982 | Japan | 72/241 |
| 206510 | 12/1982 | Japan | 72/243 |
| 1177629 | 1/1970 | United Kingdom . | |
| 440174 | 1/1975 | U.S.S.R. . | |

*Primary Examiner*—Lowell A. Larson
*Assistant Examiner*—Jorji M. Griffin
*Attorney, Agent, or Firm*—Fleit, Jacobson, Cohn & Price

[57] ABSTRACT

A roll mill stand comprising a main roll mounted in bearings encompassed by pads, and an auxiliary roll with a strip passed between the rolls. The pads and the auxiliary roll are movable on guides provided on the housing. The stand further includes a mechanism to control the profile and shape of the strip. The mechanism comprises a drive, a crosspiece with a groove, which is movable on the guides of the housing, a wedge received in the groove of the crosspiece and connected to the drive, and two cams installed in channels provided in the walls of the groove of the crosspiece. The wedge is conjugated with a collet which is mechanically coupled to the crosspiece, encompasses the auxiliary roll and has two grooves, and with two inserts, each received in a respective groove of the collet and conjugated with a respective cam.

3 Claims, 3 Drawing Figures

ROLL MILL STAND

FIELD OF THE INVENTION

The present invention relates to rolling mills and is more specifically concerned with roll mill stands.

The invention is applicable to the rolling of thin strip and band.

BACKGROUND OF THE INVENTION

The growing demand for sheet metal calls for new high-capacity rolling mills which would guarantee high-quality products. Thin strip is produced on mills with only one drive roll in each of the working stands. This design reduces the rolling force, provides for a great amount of pass reduction, decreases thickness variations, and improves the surface finish.

There is known a roll mill stand (cf. the collection of abstracts "Oborudovanie dlya prokatnogo proizvodstva"/3Rolling Equipment"/, Metallurgicheskoe oborudovanie/Metallurgical Equipment/Series, the Publishing House of TsNIITEITyazhmash, Moscow, 1979, pp. 4–6) comprising a main roll mounted in bearings encompassed by pads, and an auxiliary roll with the strip fed into the rolls. The stand further incorporates a housing with guides. The pads and the auxiliary roll are movable on said guides. Finally, the stand includes a mechanism to control the profile and shape of the strip, which comprises a drive mechanically coupled to the housing and to at least one of the rolls. The function of this mechanism is performed by at least four hydraulic cylinders accommodated in bolsters. The rods of the cylinders are mechanically connected to the auxiliary roll.

The roll mill stand described above is disadvantageous in that the design of the mechanism to control the profile and shape of the strip accounts for a relatively great load on the housing and the bearings of the main roll. This load may be as high as 15 to 40 percent of the rolling force. It reduces the life of the bearings and necessitates putting a great amount of metal into the manufacture of the stand.

In addition, the mechanism to control the profile and shape of the strip is designed so that replacement of the main roll is quite a lengthy process, which tells on the overall efficiency of the mill.

SUMMARY OF THE INVENTION

It is an object of the present invention to reduce the amount of metal put into the manufacture of roll mill stands.

It is another object of the invention to increase the service life of roll mill stands.

It is a further object of the invention to increase the efficiency of roll mill stands.

The invention provides a roll mill stand, comprising a main roll mounted in bearings encompassed by pads, and an auxiliary roll with strip fed into said rolls, a housing with guides, said pads and said auxiliary roll being movable on said guides, and a mechanism to control the profile and shape of the strip, having a drive mechanically coupled to the housing and to at least one of the rolls, the stand being characterized, according to the invention, in that the mechanism to control the profile and shape of the strip incorporates a crosspiece with a groove, which is movable on the guides of the housing, a wedge received in the groove of the crosspiece and connected to the drive, two cams received in channels provided in the walls of the groove of the crosspiece and conjugated with the wedge, a collet mechanically coupled to the crosspiece, encompassing the auxiliary roll and having two grooves, and two inserts, each received in a respective groove of the collet and conjugated with a respective cam.

The invention makes it possible to control the profile and shape of the strip by symmetrically intersecting the axes of the rolls. This guarantees a long service life of roll mill stands and makes it possible to reduce the amount of metal put into their manufacture.

In addition, the invention curtails the stand repair time, which means a greater efficiency of the mill.

BRIEF DESCRIPTION OF THE ACCOMPANYING DRAWINGS

Other objects and advantages of the present invention will become more apparent from a consideration of the following detailed description of a preferred embodiment thereof, taken in conjunction with the accompanying drawings, wherein.

DETAILED DESCRIPTION OF THE INVENTION

Figure 3:
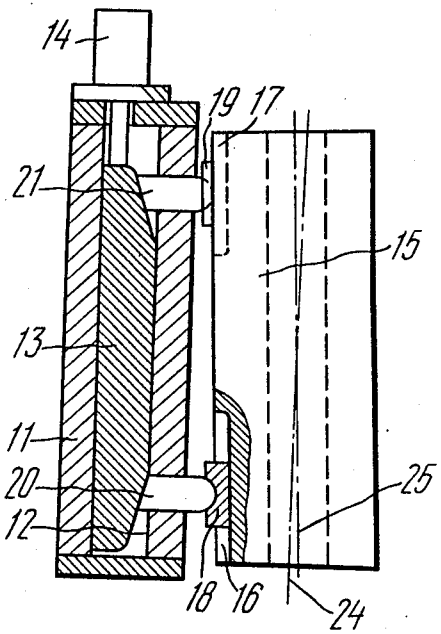
FIG. 3 is a section taken on line III—III in FIG. 2.

Referring to the attached drawings, the roll mill stand in accordance with the invention comprises a main roll 1 (FIG. 1) and an auxiliary roll 2 with the strip (not shown) fed into said rolls 1 and 2. The main roll 1 is mounted in bearings 3 and 4 installed in pads 5 and 6 movable on guides 7 and 8 of a housing 9. The stand further incorporates a mechanism 10 to control the profile and shape of the strip. The mechanism 10 comprises a crosspiece 11 with a groove 12 (FIGS. 2 and 3), which is movable on the guides 7 and 8 of the housing 9. The groove 12 receives a wedge 13 connected to a drive 14. The auxiliary roll 2 is encompassed by a collet 15 with grooves 16 and 17 which receive inserts 18 and 19, respectively. Cams 20 and 21 are interposed between the wedge 13 and the inserts 18 and 19, respectively. The cams 20 and 21 are received in channels provided in the walls of the groove 12 of the crosspiece 11. The collet 15 is pressed against the crosspiece 11 by a rod 22 and a spring 23. The point of intersection of longitudinal axes 24 and 25 of the rolls 1 and 2, respectively, is set by a bushing 26. Housing screws 27 and 28 abut against the crosspiece 11 of the mechanism 10.

The roll mill stand of this invention functions as follows.

Figure 1:
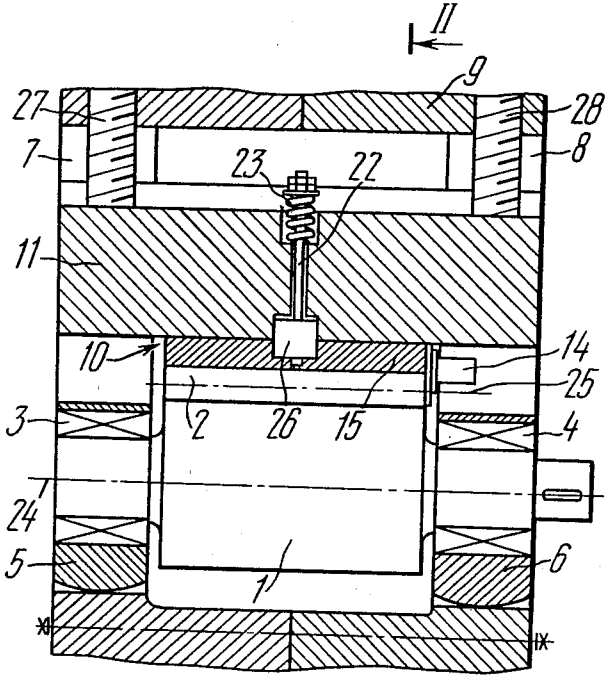
FIG. 1 is a general elevation view of a roll mill stand in accordance with the invention.
Figure 2:
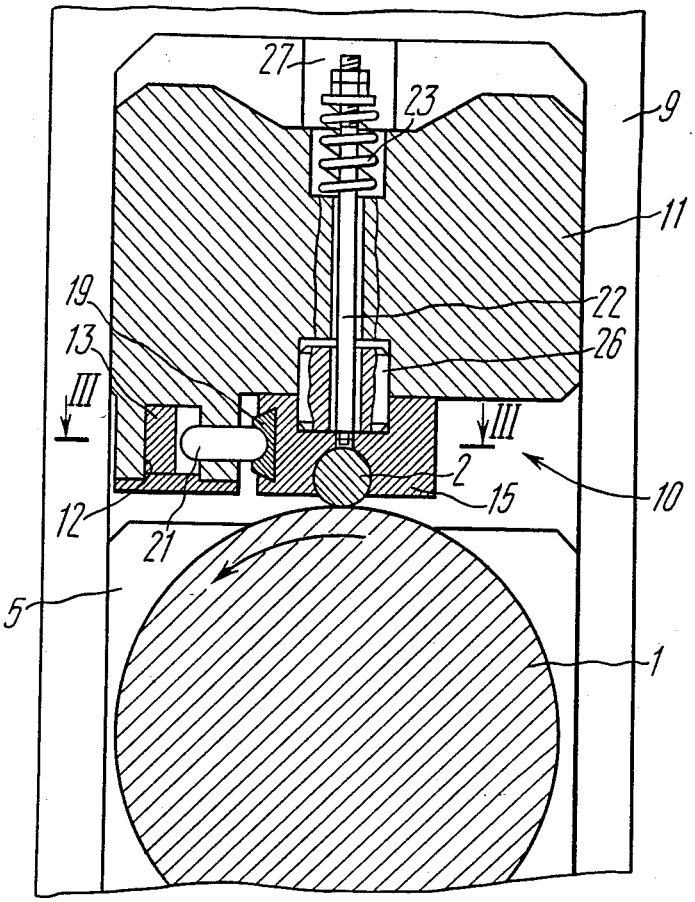
FIG. 2 is a section taken on line II—II in FIG. 1.

The strip to be rolled is fed to the stand. A desired gap between the main roll 1 and auxiliary roll 2 is set with the aid of the housing screws 27 and 28 (FIG. 1). If it is necessary to adjust the profile and shape of the strip in the course of rolling, the mechanism 10 is used to switch on the drive 14 which moves the wedge 13 (FIGS. 2 and 3) along the groove 12 of the crosspiece 11. If the wedge 13 moves towards the cam 20, the latter acts on the collet 15 which turns with the auxiliary roll 2 so that the axis 25 of the roll 2 intersects the axis 24 of the main roll 1. As the collet 15 is turned, the cam 21 moves in the direction opposite to that of the cam 20 and abuts against the wedge 13. The collet 15 turns around the bushing 26 which sets the point of intersection of the axes 24 and 25 of the rolls 1 and 2, respectively. When the wedge 13 moves in the opposite direction, the motion of the collet 15 is reversed and the angle of intersection of the axes 24 and 25 is reduced. The inserts 18 and 19 serve to reduce the contact loads in the grooves 16 and 17 of the collet 15 and on the working surfaces of the cams 20 and 21. They also serve to prevent excessive wear of said grooves 16 and 17, which would otherwise be caused by the mechanism 10.

As the axes 24 and 25 of the rolls 1 and 2, respectively, intersect, the gap between said rolls 1 and 2 acquires a profile close to the parabolic. The force required to change the gap is smaller by far than in the case of conventional roll mill stands, and the profile and shape of the strip can be controlled over a much broader range.

The invention makes it possible to control the profile and shape of the strip over any desired range without stopping the mill in order to install rolls of a different profile. This raises the efficiency of the mill and enables it to operate effectively with a limited set of rolls.

What is claimed is:

1. A roll mill comprising:

a housing;

a first pad supported in and movable relative to said housing;

a second pad supported in and movable relative to said housing;

a first bearing mounted in said first pad;

a second bearing mounted in said second pad;

a main roll rotatably mounted in said first and second bearings;

an auxiliary roll adjacent to said main roll with strip being passed between said main roll and said auxiliary roll, the axis of said auxiliary roll lying in a first transverse plane and the axis of said main roll lying in a second transverse plane, said first plane being parallel to said second plane;

a control means to control the profile and shape of the strip as the latter is being passed between said rolls, comprising:

a crosspiece carried on and movable relative to said housing and having a groove provided in one of its surfaces, and having spaced first and second channels extending transversely of and between said groove and a second surface of said crosspiece;

a wedge slidably received in said groove of said crosspiece;

a drive means connected to said wedge for moving said wedge along said groove;

a collet pivotally attached to said crosspiece and having a first groove and a second groove, said collet supporting said auxiliary roll adjacent said main roll;

a first insert received in said first groove of said collet;

a second insert received in said second groove of said collet;

a first cam movably carried in said first channel and interposed between said wedge and said first insert;

a second cam movably carried in said second channel and interposed between said wedge and said second insert;

whereby actuation of said drive means causes said wedge to slide along said groove to simultaneously move each of said cams and pivot said collet and the axis of said auxiliary roll relative to the axis of said main roll.

2. A roll mill stand in accordance with claim 1 wherein said wedge is an elongated member slidable along said groove and includes a separate wedge surface formed at each end thereof, said separate wedge surfaces engageable with respective ones of said first and second cams.

3. A roll mill stand in accordance with claim 1 including a bushing carried in said crosspiece and having its axis passing through the axis of said main roll, and wherein said collet pivots about a single pivot axis coincident with said bushing axis.

* * * * *